US008925902B2

(12) United States Patent
Von Linsingen-Heintzmann et al.

(10) Patent No.: US 8,925,902 B2
(45) Date of Patent: Jan. 6, 2015

(54) VEHICLE RESTRAINT SYSTEM WITH WEIGHTING BODY

(75) Inventors: Barbara Von Linsingen-Heintzmann, Bochum (DE); Horst Lass, Bochum (DE); Walter Klein, Katzwinkel (DE); Werner Heimann, Spiesen-Elversberg (DE)

(73) Assignee: Heintzmann Sicherheitssysteme GmbH & Co. KG, Bochum (DE)

( * ) Notice: Subject to any disclaimer, the term of this patent is extended or adjusted under 35 U.S.C. 154(b) by 7 days.

(21) Appl. No.: 13/383,336

(22) PCT Filed: Oct. 12, 2010

(86) PCT No.: PCT/DE2010/001196

§ 371 (c)(1),
(2), (4) Date: Jan. 10, 2012

(87) PCT Pub. No.: WO2011/047659

PCT Pub. Date: Apr. 28, 2011

(65) Prior Publication Data

US 2012/0104338 A1 May 3, 2012

(30) Foreign Application Priority Data

Oct. 21, 2009 (DE) ..... 10 2009 050 266

(51) Int. Cl.
*E01F 15/00* (2006.01)
*E01F 15/08* (2006.01)

(52) U.S. Cl.
CPC ..... *E01F 15/085* (2013.01)
USPC ..... 256/13.1

(58) Field of Classification Search
CPC ..... E01F 15/02; E01F 15/025; E01F 15/04; E01F 15/0407; E01F 15/0446
USPC ..... 256/13.1; 404/6, 9
See application file for complete search history.

(56) References Cited

U.S. PATENT DOCUMENTS 4,498,803 A * 2/1985 Quittner ..... 404/6
4,553,875 A * 11/1985 Casey ..... 256/13.1
4,954,009 A 9/1990 Kellison
5,425,594 A * 6/1995 Krage et al. ..... 256/13.1
5,868,521 A * 2/1999 Oberth et al. ..... 256/13.1
6,536,986 B1 * 3/2003 Anghileri et al. ..... 404/6

(Continued)

FOREIGN PATENT DOCUMENTS

DE 30 36 227 A1 10/1982
DE 93 18 531 * 3/1994 ..... E01F 11/00

(Continued)

*Primary Examiner* — Michael P Ferguson
(74) *Attorney, Agent, or Firm* — Henry M. Feiereisen LLC

(57) ABSTRACT

The present invention relates to a vehicle restraint system (1) for delimiting roadways, including base bodies (3) that can be detachably coupled to each other, wherein the base bodies (3) can be placed on a road surface (4) and have at least one weighting body (5). The weighting bodies (5) are formed by a outer casing (6), which is filled with a curable filler (7). Provided on the weighting bodies (5) are fasteners (8) which project out in relation to the weighting body (5), wherein the weighting bodies (5) can be fastened in the base body (3) by means of the fasteners. The vehicle restraint system (1) stands on the road surface (4) by means of support feet (19). The support feet (19) include a main body (20) and an elastomer body (21).

13 Claims, 4 Drawing Sheets

(56) References Cited

U.S. PATENT DOCUMENTS

| | | | | |
|---|---|---|---|---|
| 6,811,144 | B2 * | 11/2004 | Denman et al. | 256/13.1 |
| 6,863,468 | B2 * | 3/2005 | Davis et al. | 404/6 |
| 6,905,281 | B2 * | 6/2005 | Kang | 404/6 |
| 7,604,221 | B2 | 10/2009 | Lass et al. | |
| 7,950,871 | B2 | 5/2011 | Lass et al. | |
| 2006/0024826 | A1 | 2/2006 | Bonassar et al. | |
| 2008/0067484 | A1 * | 3/2008 | Amengual Pericas | 256/13.1 |
| 2011/0031456 | A1 | 2/2011 | Von Linsingen-H. et al. | |

FOREIGN PATENT DOCUMENTS

| | | | | |
|---|---|---|---|---|
| DE | 94 16 463.0 | | 1/1995 | |
| DE | 298 15 850 | U1 | 12/1998 | |
| DE | 200 03 791 | U1 | 6/2000 | |
| DE | 102007023788 | | 9/2008 | |
| FR | 2 745 596 | A1 | 9/1997 | |
| GB | 2 063 973 | * | 6/1981 | E01F 15/00 |

* cited by examiner

VEHICLE RESTRAINT SYSTEM WITH WEIGHTING BODY

CROSS-REFERENCES TO RELATED APPLICATIONS

This application is the U.S. National Stage of International Application No. PCT/DE2010/001196, filed Oct. 12, 2010, which designated the United States and has been published as International Publication No. WO 2011/047659 and which claims the priority of German Patent Application, Serial No. 10 2009 050 266.1, filed Oct. 21, 2009, pursuant to 35 U.S.C. 119(a)-(d).

BACKGROUND OF THE INVENTION

The invention relates to a vehicle restraint system for delimiting roadways, including base bodies that can be detachably coupled to one another, wherein the base bodies can be placed on a road surface and have at least one weighting body.

Vehicle restraint systems for delimiting roadways are known from the prior art. DE 200 03 791 U1 discloses a mobile protective steel wall for delimiting roadways made of individual wall segments which can be arranged end-to-end. Every wall segment has crash barriers arranged in parallel to the roadway and resting on at least two supports standing on plate-like foot members. The crash barriers are bolted to mounting surfaces that extend upwards from the supports and vertically relative to the roadway. Finally, the mobile protective steel wall is formed by two opposing mounting surfaces with bolted-on crash barriers. Located in between the bottom crash barriers is a heavy material.

Protective steel walls that are built according to this design have the disadvantage of possessing a high dead weight. Especially for storage, transport and installation elaborate aids for generating large forces are required for moving the protective steel walls. Thus, the protective steel walls have to be short to keep the weight of each individual segment low.

Several protective steel walls linked end-to-end can have a poor tension strap property in the case of a vehicle impact resulting in a poor protective characteristic.

US 2006/024826 discloses a vehicle restraint system which has an internal container for the uptake of water, sand or similar fillers. Up until the filling process, the entire vehicle restraint system is relatively lightweight. The container can be filled within the vehicle restraint system through openings in the head region of the vehicle restraint system and emptied through openings in the foot region of the vehicle restraint system. The container is connected to the vehicle restraint system and is malleable in its unfilled state and thus folds in when segments of the vehicle restraint system are stacked upon each other. During refilling, the container recovers its initial position.

This system is disadvantageous in that the vehicle restraint system has to be filled with weighting material after being deployed at the desired location. This filling process is quite elaborate, time-consuming and cost-intensive. Additionally, the unfavorable weight distribution of the filler inside the container with regard to the vehicle restraint system results in a high center of gravity, depending on the filling degree.

SUMMARY OF THE INVENTION

Therefore, based on the state of the art, the object of the present invention is to provide a vehicle restraint system which can realize different restraint levels through superstructures and different coupling variants and through loading or unloading.

The afore-mentioned object is solved by a weighting body having a outer casing which is filled with a curable filler, and fasteners provided on the weighting body and protruding in relation to the weighting body, thus allowing the weighting body to be fixed in the base body through, or by means of, the fasteners.

The advantage of the solution according to the present invention is that the base bodies of the vehicle restraint system can be equipped with weighting bodies in a modular fashion. The weighting bodies are designed to be particularly easy to store, transport and install. Depending on the demands on the restraint value of the vehicle restraint system, the base bodies can be equipped with single or several weighting bodies.

The weighting bodies have fasteners for fastening in the base bodies. This offers the particular advantage that the weighting bodies can be mounted inside the base body through the fasteners or arranged before or after mounting through engagement on the fasteners.

In the case of a collision of a vehicle with the base body, the weighting bodies remain securely anchored in their position and therefore cannot flail. At their top end, the base bodies further have means for receiving superstructures and thus are adaptable in height.

Maximal loading of the vehicle restraint system with weighting bodies results in a high restraint level with small transversal displacement. Thus, restraint levels T1 to T3 can be realized through the loading state of the system.

Preferably, the weighting body has a cylindrical shape. This offers the particular advantage that the cylindrical shape can be optimally integrated into the base body. Because of the cylindrical design, the weighting body contacts the base body on each side only in one line. This provides for a sufficient deformation behavior of the remaining part of the base body above and below the line of contact. A cylindrical shape further promotes transport and storage of weighting elements and further offers an optimal size-weight ratio.

Further shapes of the weighting body are also subject matter of the present invention. The outer geometry of the weighting body can be adapted to the inner contour of the base body to achieve a maximal weighting of the base body.

In a preferred embodiment, the weighting body has a length of 50 to 200 cm, a width of 10 to 35 cm and a height of 10 to 35 cm. Especially preferred is a length between 85 and 95 cm.

According to the invention, a cylindrical shape of the outer casing also relates to a cross sectional profile that is circular, elliptical, angular or any combination of the afore-mentioned features.

Preferably, the outer casing of the weighting body is formed as a plastic tube. During manufacturing this offers a particularly simple manufacturing design of a permanent formwork and gives the weighting body greater dimensional stability. During use of the vehicle restraint system, the plastic tube has the further advantage of minimizing the projection effect of the curable filler located inside the plastic tube. During assembly and disassembly of vehicle restraint systems, a plastic tube also protects the weighting bodies particularly well against external influences from shock or weather conditions. Preferably, the plastic tube has a diameter of about 25 cm and a wall thickness in the range of 1 to 20 mm.

In a preferred embodiment of the present invention, the curable filler is concrete. This offers the advantage that the filler can be very easily introduced into the outer casing as fluid where it then cures. A further advantage of concrete is that it can be favorably used during manufacture and, because of the density of concrete, an optimal size to weight ratio can be achieved with regard to the geometric shape of the weighting body. Especially suitable as filler is a B25-concrete.

Preferably, reinforcing bars are cast-in in the curable filler. The curable filler tends to have a brittle material property and can thus break from shocks which occur during assembly or transport. The reinforcing bars provide additional dimensional stability to the cured filler in the outer casing. In a possible embodiment, the reinforcing bars are disposed in the inside of the outer casing as cross struts, such that they prevent shifting of the curable filler inside of the outer casing.

The fasteners are preferably formed as mounting brackets, wherein the mounting brackets are located at the ends of the weighting body. With the aid of the mounting brackets, the weighting bodies are particularly advantageously mountable in the base body. To ensure a particularly easy modular assembly of the vehicle restraint system, the mounting brackets are formed with protruding legs which point in the longitudinal direction of the weighting body. Further, the mounting brackets prevent shifting of the cured filler in axial direction inside the outer casing after manufacture of the weighting body. Through the shape of the mounting brackets the weighting body can be adapted to the respective vehicle restraint system or the respective base body, respectively.

In a preferred embodiment, the mounting brackets have an abutment section which is formfittingly fixed in the weighting body by the curable filler. According to the invention, an abutment section relates to an extension of the mounting bracket in axial direction of the outer casing. To achieve an optimal formfitting connection between curable filler and the abutment section, the extension is shaped in a particular way at its end. For example, at its end the extension can be spread out or have a thickening. Particularly preferably, the abutment section is formed as Nelson-anchor.

To achieve an additional increase of the strength of connection between the mounting bracket and the weighting body, a forced connection between the abutment section and the curable filler can be generated by using an additive. In a further embodiment according to the present invention the mounting brackets can also be bolted to the weighting body.

Preferably, the mounting brackets at the end faces of the weighting body have different leg lengths in longitudinal direction of the weighting body. This offers the advantage to accommodate the different receiving areas for weighting bodies of different vehicle restraint systems. Further, through the different leg lengths, the weighting body is defined in its orientation, which means that an accidental switching of left and right side is excluded.

In a preferred embodiment, a weighting body with one mounting bracket on each end face is mountable on runners in a foot area of the base body, especially preferably through formfitting mounting with through bolts. In this case, the runners of the base body extend in cross direction with regard to the base body. By mounting the weighting body in the foot area, a low center of gravity is established for the base body and particularly for the vehicle restraint system as a whole. The low center of gravity allows for a high tilt resistance in case of a collision of a vehicle with the vehicle restraint system as well as small displacement perpendicular to the roadway. Mounting with through bolts allows for a particularly cost-efficient, simple and fast mounting and at the same time offers high reproducibility and quality of the generated connection, independent of the experience of the installer.

Preferably, the runners of the base body have oblong holes extending in longitudinal direction with regard to the base body, with two mounting brackets from neighboring weighting bodies being fastened in common oblong holes. In combination with the fastening of mounting brackets on the runners by means of through bolts, the oblong holes form the analogous counterpart to through bores in the mounting brackets for receiving the through bolts. The oblong holes in the runners allow for clearance in longitudinal direction of the weighting bodies for mounting in the base bodies. This makes the overall assembly easier especially when several weighting bodies are arranged in a base body.

In a further preferred embodiment, the base bodies have support feet on a bottom side of the runners, wherein a support foot is formed by an elastomer body which is connected to a metallic main body. Preferably, the elastomer body has a hardness of more than 50 Shore, especially preferred 70 Shore. Suitably, the support feet are fixed to the runners. The runners are provided with oblong holes for receiving threaded bolts of the support feet, with the oblong holes extending perpendicularly to the road surface.

In the event of a collision of a vehicle with the vehicle restraint system, a first energy dissipation occurs in view of a displacement of the vehicle restraint system via the oblong holes. As a result, the base body shifts on the support feet transversely to the road. The support feet remain firmly standing on the road surface until the end of the distance or possible avoidance provided by the oblong holes is reached. Subsequently, displacement of the vehicle restraint system is kept small through the connection of the vehicle restraint system with the road surface through the elastomer bodies. This has the advantage that inadmissibly high transverse forces are avoided. The degree of severity of acceleration exerted on the vehicle passengers is lowered by the inventive solution. An example for measuring the degree of severity is the ASI-value, Acceleration Severity Index.

Further, the elastomer body offers the advantage to compensate tolerances in the road surface over the length of the base body for the coupling of a second base body.

In a further preferred embodiment, the runners of the base body have oblong holes which are oriented towards the road. In the event of a collision with a vehicle, a first dissipation of energy can occur on these holes through displacement perpendicular to the road, reducing the force of impact.

Preferably, a base body has holes at its end faces, to connect several base bodies end-to-end to one another. This results in a very good tension strap property of the vehicle restraint system in the event of a collision with a vehicle. Preferably, couplers in the form of threaded bolts are used as connection. The base bodies can be connected to each other through a central hole or through two holes in side-by-side relationship, depending on the desired restraint level. For a low restraint level, two base bodies can be connected through a central hole, and for a higher restraint level, the base bodies can be coupled through two holes in side-by-side relationship.

Further, superstructures can be added to the base bodies to achieve a higher restraint level. The superstructures are fixed on the base bodies with coarse threaded bolts. For this purpose internal threads are present on a sheet metal in the interior space of the base body, with the sheet metal extending horizontally along the length of the base body. At the same time, this sheet metal improves the deformation characteristics of the base body in event of a collision.

BRIEF DESCRIPTION OF THE DRAWING

Further advantages, features, properties and aspects of the present invention follow from the description below. Preferred embodiments are shown in the drawings which merely serve for ease of understanding of the invention. It is shown in.

DETAILED DESCRIPTION OF PREFERRED EMBODIMENTS

In the Figures, same reference signs are used for same or similar parts, whereby corresponding or comparable advantages are achieved even though, for sake of simplification, a repetitive description is omitted.

Figure 1:
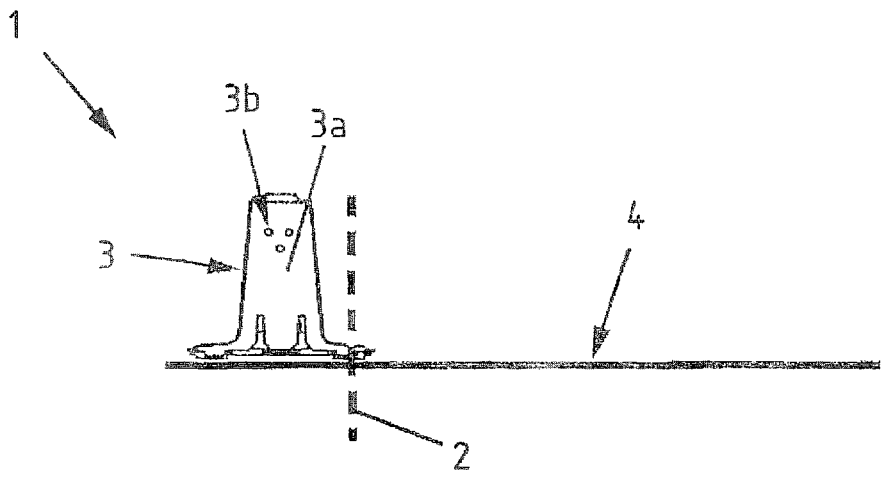
FIG. 1 a frontal view of a base element of a vehicle restraint system on a roadway surface.

FIG. 1 shows a vehicle restraint system 1 for roadway delimitation 2 of a road. For this purpose, base bodies 3 are coupled to one another and placed on a road surface 4. A vehicle colliding with the vehicle restraint system 1 is restraint from leaving the road, and driving over the roadway delimitation 2 is prevented reliably. Further, the base body 3 has face plates 3*a*. The face plates 3*a* are provided with three holes 3*b* to connect two base bodies 3 by means of couplers.

Figure 2:
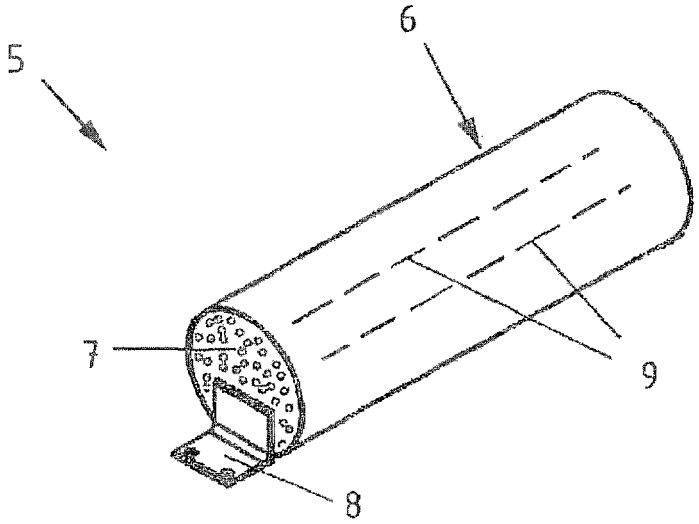
FIG. 2 a perspective plan view of a weighting body according to the invention.

FIG. 2 shows a weighting body 5 for the fixation in a base body 3 of a vehicle restraint system 1. The weighting body 5 is constructed as follows; it is surrounded by a outer casing 6 which is filled with a curable filler 7. Preferably, the outer casing 6 is a plastic tube, and the curable filler 7 is a concrete. Attached to the weighting body 5 are fasteners 8. These fasteners 8 are preferably cast into the weighting body 5. Further, the weighting body 5 has within the interior in addition to the curable filler 7 reinforcing bars 9 which are schematically indicated in FIG. 2. The reinforcing bars prevent the curable filler 7 from breaking or breaking out piece-by-piece from the outer casing 6.

Figure 3:
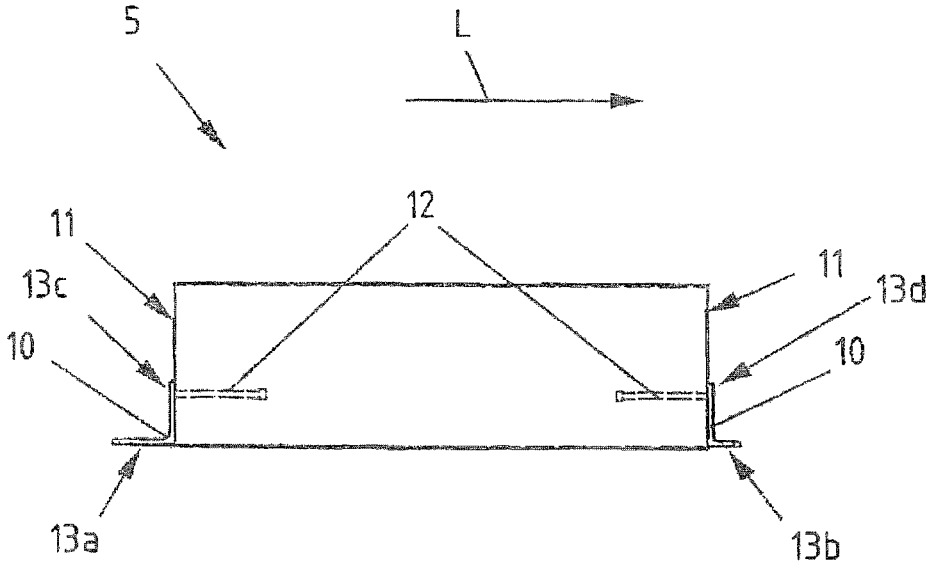
FIG. 3 a side view of a weighting body with mounting brackets according to the invention.

In FIG. 3, the weighting body 5 according to the invention is shown in a side view. Here, the fasteners 8 are formed as mounting brackets 10. The weighting body 5 according to the invention has a cylindrical shape which is delimited on both sides by end faces 11. The mounting brackets 10 are hereby located at the end faces 11. A mounting bracket 10 has abutment sections 12 for fixation on the weighting body 5. The abutment sections 12 are preferably formed as Nelson-anchors and are cast into the curable filler 7. This results in a formfitting connection between the mounting bracket 10 and the weighting body 5. In a preferred embodiment, the weighting body 5 has different leg lengths of horizontal legs 13*a*, 13*b*, which project out in relation to the end faces 11 in longitudinal direction L of the weighting body 3. Through the different leg lengths 13*a*, 13*b*, the weighting body 5 is thus defined in its orientation. Vertical legs 13*c*, 13*d* of the mounting brackets 10 rest against the end faces 11 of the weighting body 3.

Figure 4:
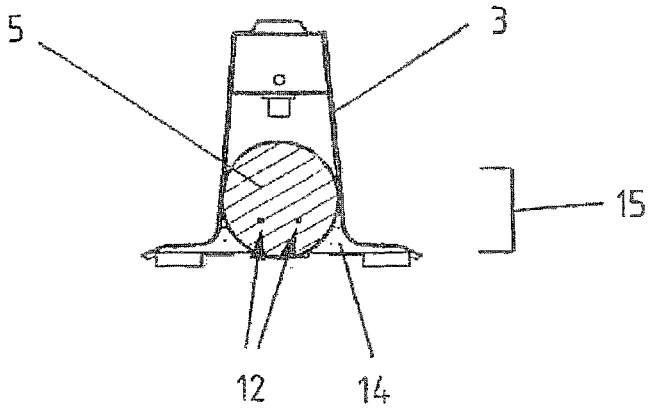
FIG. 4 vertical cross section of a base element of a vehicle restraint system with mounted weighting body.

FIG. 4 shows a schematic cross section of a vehicle restraint system 1 with installed weighting body 5 according to the invention. The weighting body 5 is fixed in the vehicle restraint system 1 to runners 14 by means of the mounting brackets 10. The cross section of the weighting body 5 shows the abutment sections 12. Preferably, the weighting body 5 is arranged in the vehicle restraint system 1 in the foot area of the vehicle restraint system 1 such that a low center of gravity results.

Figure 5:
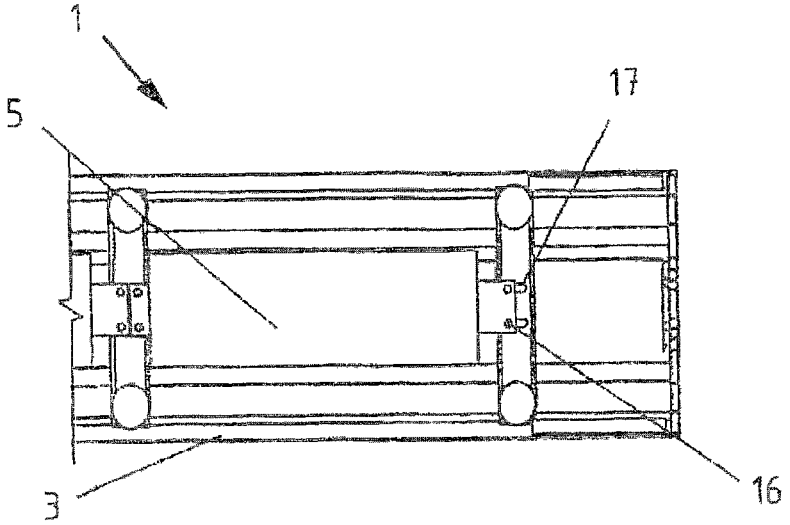
FIG. 5 a bottom view of a base element of a vehicle restraint system with weighting body according to the invention.

FIG. 5 shows a schematic bottom view of the vehicle restraint system 1. Weighting bodies 5 are mounted in the vehicle restraint system 1. Installation takes place through the mounting brackets 10 by means of through bolts 16 in the mounting brackets 10, which through bolts 16 in turn engage in the oblong holes 17 in the runners 14 of the vehicle restraint system 1. Here, it can be clearly recognized that the weighting bodies 5 are defined in their orientation by the different leg lengths 13*a*, 13*b*. Preferably, a weighting body 5 is fixed on each end with two through bolts 16 in the oblong holes 17. The through bolts 16 of neighboring weighting bodies 5 engage the same oblong holes 17 of a runner 14.

Figure 6:
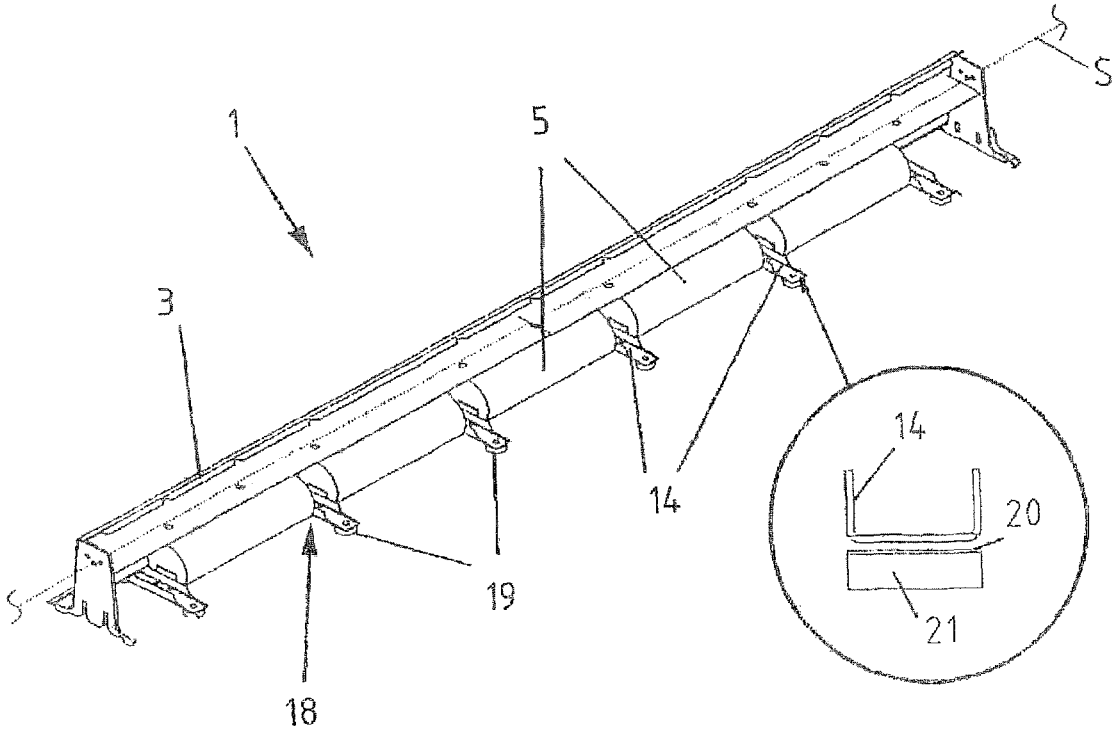
FIG. 6 a perspective sectional view of a base body of a vehicle restraint system with weighting body according to the invention.

FIG. 6 shows a three-dimensional overall view of a base body 3 of a vehicle restraint system 1 with weighting bodies 5 from a bottom perspective. Here, it can be recognized that several weighting bodies 5 are mounted in a base body 3. This fully pre-assembled base body 3 with weighting bodies 5 is placed on the road surface 4 and rests on the road surface 4 with its support feet 19 mounted on the bottom 18 of the base body 3. FIG. 6 shows a detailed view of a support foot 19 in a side view. Preferably, the support feet 19 have a main body 20 with an attached elastomer body 21. Further shown in FIG. 6 is a continuous steel cable S which traverses through the face plates 3*a*. In the case of coupling of base bodies 3 which are arranged end-to-end and not shown in greater detail, the continuous steel cable S additionally connects the base bodies 3 so as to provide a higher restraint level in the event of an impact.

Figure 7:
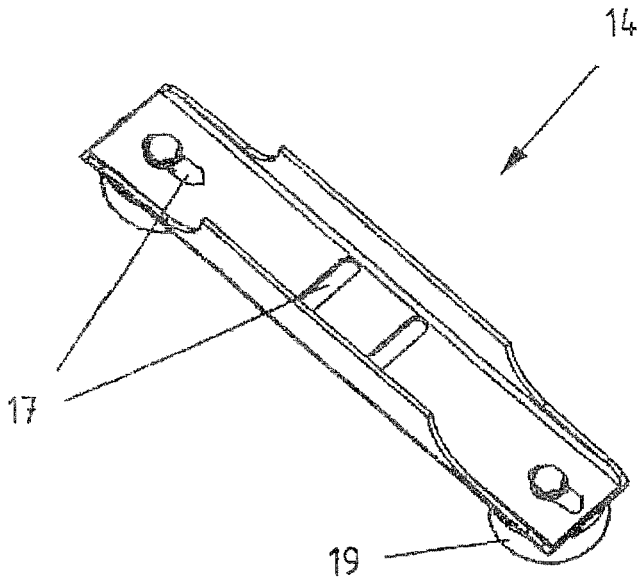
FIG. 7 a detailed view of a runner of a base body.

FIG. 7 shows a perspective plan view of a runner 14. In its middle area, the runner 14 has oblong holes 17 extending parallel to the longitudinal axis of the base body, and in its peripheral areas it has oblong holes 17 which extend perpendicularly to the road surface. The support feet 19 are mounted on the oblong holes 17 of the peripheral areas.

Figure 8:
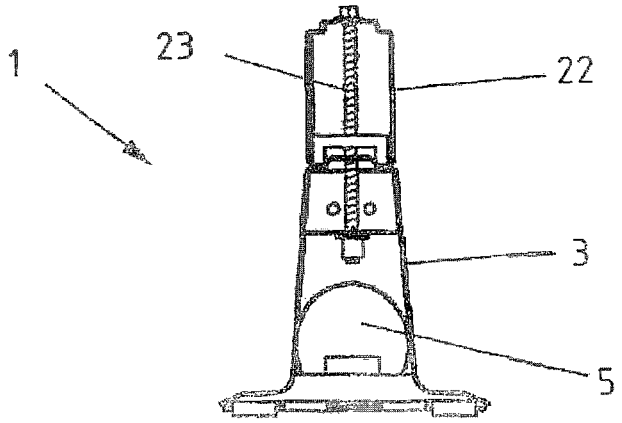
FIG. 8 a vertical cross section of a base element of a vehicle restraint system with superstructure.

FIG. 8 shows a vertical cross section through a base body 3 with mounted superstructure 22. The superstructure 22 is mounted on the base body 3 with coarse threaded bolts. Additionally, the weighting body 5 is mounted in the base body 3. Because the weighting body 5 is mounted in the foot area 15 of the base body 3, the base body 3 with the mounted superstructure 22 has a low center of gravity.

What is claimed is:

1. A vehicle restraint system for delimiting a roadway, said vehicle restraint system comprising:

a base body for placement upon a road surface, said base body comprising a longitudinal rail and a pair of opposing face plates respectively arranged on opposite ends of the longitudinal rail and extending downwardly from the longitudinal rail for engaging the road surface, said longitudinal rail and said face plates together enclosing an inner space of the base body, and each of said face plates comprising means for detachable connection of the base body with at least one further base body;

a plurality of runners arranged in a lower portion of the inner space of the base body for engaging the road surface, each of said runners having a first oblong hole extending in a longitudinal direction of the base body and a second oblong hole extending in a transverse direction of the base body;

a plurality of cylindrical weighting bodies, each having a circular cross section and opposite end faces and comprising a casing filled with a curable filler, said casing being configured as a plastic pipe, said weighting bodies being longitudinally aligned with said longitudinal rail and arranged adjacent one another in the lower portion of the inner space of the base body so that respective ones of the opposite end faces of neighboring weighting bodies confront each other; and a plurality of fasteners, provided on the opposite end faces of the weighting bodies and projecting out in relation to the weighting bodies, said weighting bodies being releasably fixed on the runners with the fasteners, wherein the fasteners of the confronting end faces of adjacent said weighting bodies are fixed in the first oblong hole of a respective said runner.

2. The vehicle restraint system of claim 1, wherein the curable filler is made of concrete.

3. The vehicle restraint system of claim 1, further comprising reinforcement bars cast in the curable filler.

4. The vehicle restraint system of claim 1, wherein the fasteners are configured as mounting brackets.

5. The vehicle restraint system of claim 4, wherein each said mounting bracket has an abutment section fixed formfittingly in a respective one of the weighting bodies by the curable filler.

6. The vehicle restraint system of claim 4, wherein one of the mounting brackets at a first end face of each said weighting body has a horizontal leg defined by a first length, and another one of the mounting brackets at a second end face of each said weighting body has a horizontal leg defined by a second length, said first length being different than the second length.

7. The vehicle restraint system of claim 6, further comprising bolts for formfitting mounting the mounting brackets onto the runners.

8. The vehicle restraint system of claim 1, wherein each of the runners has a support foot on a bottom side thereof, said support foot being formed from a metallic main body and an elastomer body connected to the main body.

9. The vehicle restraint system of claim 8, wherein the elastomer body has a hardness of more than 50 shore.

10. The vehicle restraint system of claim 8, wherein the elastomer body has a hardness of 70 shore.

11. The vehicle restraint system of claim 8, wherein each said support foot is mounted in the second oblong hole of a respective said runner.

12. The vehicle restraint system of claim 1, wherein said means for detachable connection of the base body with the at least one further base body include holes provided on the face plates and a coupler for engagement in said holes.

13. The vehicle restraint system of claim 12, further comprising a steel cable for coupling the base body to a further base body to one another, wherein the steel cable traverses the face plates.

* * * * *